US005331877A

United States Patent [19]

Ishii

[11] Patent Number: 5,331,877

[45] Date of Patent: Jul. 26, 1994

[54] ROTARY BLADE ASSEMBLY FOR A TILE CUTTER

[75] Inventor: Akinori Ishii, Hyogo, Japan

[73] Assignee: Ishii Chokokogu Mfg. Co., Ltd., Hyogo, Japan

[21] Appl. No.: 97,435

[22] Filed: Jul. 27, 1993

[30] Foreign Application Priority Data

Jun. 2, 1993 [JP] Japan ..... 5-029347[U]

[51] Int. Cl.[5] ..... B26D 3/08; B28D 1/22

[52] U.S. Cl. ..... 83/886; 83/665; 83/676; 83/698.11; 125/23.02; 225/96.5

[58] Field of Search ..... 225/96.5, 96; 83/884, 83/886, 887, 331, 665, 666, 676, 698; 30/164.95; 125/23.02, 23.01

[56] References Cited

U.S. PATENT DOCUMENTS

| | | | |
|---|---|---|---|
| 2,239,454 | 4/1941 | Carlson | 83/886 |
| 3,800,991 | 4/1974 | Grove et al. | 225/96.5 X |
| 4,217,693 | 8/1980 | Roder et al. | 83/886 X |
| 5,040,445 | 8/1991 | Liou | 225/96.5 X |

*Primary Examiner*—Eugenia Jones
*Attorney, Agent, or Firm*—Koda and Androlia

[57] ABSTRACT

A rotary blade assembly used in a tile cutter made of cylindrical inner and outer races, a plurality of metal balls installed between the inner and outer races, a pair of covers covering the inner and outer races so as to assemble the two races into a single unit, and a ring-shaped blade fixed in a groove on the outer surface of the outer race. The blade assembly is easily mounted on a pivotal sliding lever of a tile cutter and no axial nor radial play occurs during the cutting since the blade of the blade assembly can rotate smoothly via the metal balls so that it travels smoothly on the tile surface to make a sharp cut in the tile.

2 Claims, 2 Drawing Sheets

ROTARY BLADE ASSEMBLY FOR A TILE CUTTER

BACKGROUND OF THE INVENTION

1. Field of the Invention

The present invention relates to a rotary blade used in a tile cutter and more particularly to a rotary blade assembly that includes a rotary blade for cutting ceramic tiles that will be installed on the surfaces of walls, floors, etc.

2. Prior Art

A conventional device for cutting tiles to prescribed dimensions includes a base plate, guide rails installed above the base plate, an operating lever provided on the guide rails so as to pivot and slide above the base plate, a rotary blade mounted to the operating lever so as to cut a tile placed on the base plate, and a pressing plate affixed to the operating lever so as to press and split the tile.

FIG. 2 shows a tile cutter of this type.

In this Figure, the reference numeral 1 is a roughly rectangular base plate. The base plate 1 has a central projecting strip 2 oriented in the direction of the length of the base plate 1. Tile supporting surfaces 3 are formed roughly at the same height as the projecting strip 2 on both sides of the projecting strip 2. The tile supporting surfaces 3 are covered with elastic films.

A pair of guide rails 4 are supported by stands 5 which are installed at both ends of the base plate 1. The guide rails 4 are positioned above the projecting strip 2, and a lever slider 6 is installed on the guide rails 4. The lever slider 6 is free to move or slide on the guide rails 4. A pivotal operating lever 7 that has a base part 8 is connected to the lever slider 6, andrea rotary blade 9 is attached to the lower end of this base part 8. In addition, a pressing plate 10 is installed on the lower end of the base part 8 of the operating lever 7. The pressing plate 10 is used when the tile, after being cut by the rotary blade 9, is pressed to be split on the base plate 1. The pressing plate 10 is positioned in front of the rotary blade 9 relative to the moving direction B (described below) of the operation lever 7.

Ordinarily, the rotary blade 9 is made of a super-hard metal (alloy) such as tungsten carbide, etc., and as seen in FIG. 3 the blade 9 is in a relatively thin disk shape with a bolt hole **9*b* opened at the center. The blade 9 has cutting edge 9*a* on the rim portion. The cutting edge 9*a*** is in a V-shaped cross section.

The blade 9 is mounted to the base part 8 of the operating lever 7 via an attachment shaft 11. The attachment shaft 11 is passed through the bolt hole **9*b* of the rotary blade 9 and is fastened to the base part 8 of the operating lever 7 so that the blade 9 is rotatable about the attachment shaft 11**.

The above-described pressing plate 10 is mounted to the operating lever 7 via a bolt, which is at the central portion of the upper surface of the pressing plate 10, so that the pressing plate 10 is swingable relative to the operating lever 7. When the rotary blade 9 is being used to cut the tile, the pressing plate 10 is turned upward and held in a high position above the base plate 1.

In use, a tile is placed on the supporting surfaces 3 of the base plate 1, and the rotary blade 9 is pressed against one end of the surface of the tile by pivoting down the pivotal lever 7 in the direction of arrow A in FIG. 2. Then, the operation lever 7 is moved or slid in the direction of arrow B. As a result, a cut is made in the tile surface. When the rotary blade 9 reaches the other end of the tile, the pressing plate 10 is brought down to its "use position" and is pressed against the tile surface. When the tile surface is thus pressed on both sides of the projecting strip 2, the tile is split into two along the cut line.

When making a cut on the tile surface, it is essential that an accurate cut be made along the intended splitting line of the tile surface in order to obtain a good cutting or splitting.

However, in the conventional rotary blade, the attachment shaft is loosely passed through a central hole of the rotary blade to secure a smooth rotation of the rotary blade on the attachment shaft. As a result, the rotary blade has a certain amount of play when the blade is pressed against the tile surface and rotated on the tile surface. Accordingly, the cut made in the tile surface tends to be wide and shallow with collapsed edges, and when the tile is split with such an uneven cut, the split may deviate from the predicted splitting line.

Furthermore, when the rotary blade is pressed against the tile surface and moved, the rotary blade rotates while being directly in contact with the attachment shaft. As a result, there is a large frictional resistance, and a smooth rotation of the blade is hindered. Also, a large operating force is required, which would affect the working efficiency.

SUMMARY OF THE INVENTION

Accordingly, the primary object of the present invention is to provide a rotary blade for a tile cutter which cuts a tile accurately along intended splitting lines.

In order to accomplish the object, the present invention utilizes a unique structure wherein a cutter blade is employed as a part of a rotary blade assembly which is, as a single unit, mounted to an operation lever and consists of a bearing part and a cutting part. The bearing part is made up of an inner race and an outer race with rotatable balls in between, and the cutting part which is a blade of somewhat a ring shape is fixed in a circular groove formed on the external surface of the outer race of the bearing part.

Since the blade rotates along with the outer race via balls rotatable on the inner race, the blade has no axial or radial play relative to the tile surface and is-smoothly rotated. Furthermore, the rotational friction can be minimal, and smooth movement on the tile surface is secured. Accordingly, an accurate cut which is deep and narrow can be made in the tile surface. In addition, since the blade is a part of the blade assembly, it is easy to mount the blade to the operation lever of a tile cutter.

DETAILED DESCRIPTION OF THE INVENTION

One embodiment of the present invention will be described below with reference to the accompanying drawings.

Figure 1:
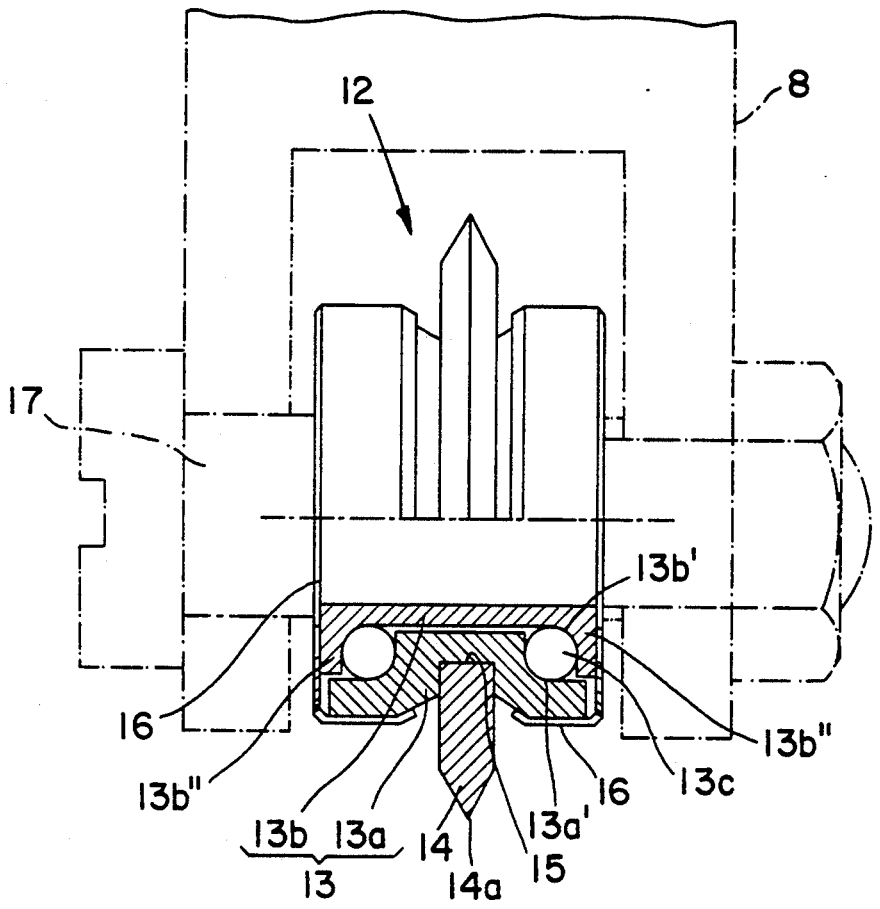
FIG. 1 shows the rotary blade assembly according to the present invention mounted to an operation lever of a tile cutter, the lower half of the blade assembly being shown in cross section.
Figure 2:
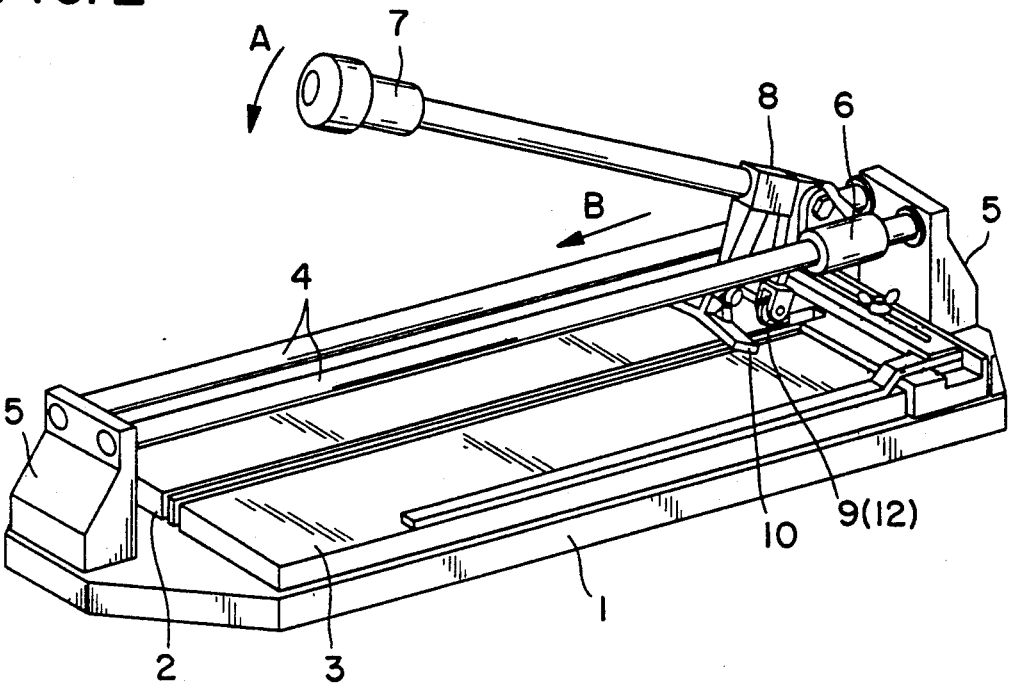
FIG. 2 is an overall perspective view of a tile cutter in which the blade assembly of the present invention is used.

In FIG. 1, the numeral 12 refers to a rotary blade assembly according to the present invention, and the rotary blade assembly 12 is made of a bearing part 13 and a cutting part 14.

The bearing part 13 comprises a round outer race 13*a* and a round inner race 13*b*. These outer and inner races are substantially cylinders with the inner race 13*b* inside the outer race 13*a*. FIG. 1 shows the two races with their axes horizontally set. Ball mounting sections 13*a*' and 13*b*' are formed on both outer and inner races 13*a* and 13*b* so that the ball mounting section of the inner and outer races face each other. A plurality of (only two are shown in FIG. 1) balls 13*c* made, for example, of metal are installed in the mounting sections so that the balls 13 are rotatably sandwiched by the outer and inner races 13*a* and 13*b*. Thus, the outer race 13*a* can smoothly rotate in the circumferential direction around the inner race 13*b*.

In this embodiment, the inner race 13*b* is a cylinder with outwardly extending flanges 13*b*'' at both ends (right and left ends in the drawing), and the outer race 13*a* is a cylinder of a larger diameter than the inner race 13*b* with a circumferential recess formed in the middle portion. When the outer race 13*a* is set around the inner race 13*b*, two circular pipe-shaped empty spaces are formed between the two races 13*a* and 13*b* by way of the ball mounting sections 13*a*' and 13*b*', and balls 13*c* are installed in these circular spaces.

The outer race 13*a* is provided with a circular groove 15 formed on the outer surface of the circumferential recess, and the cutting part 14 is installed in this groove 15.

The cutting part 14 is a somewhat ring shape blade 14, and the blade 14 is securely fixed in the circular groove 15 of the outer race 13*a* of the bearing part 13. The blade 14 has a cutting edge 14*a* on the outer circumference. The cutting edge 14*a* has a V-shaped cross section. The blade 14 is made of a super-hard metal (alloy) such as tungsten carbide, etc.

The outer race 13*a* with the blade 14 and the inner race 13*b* are assembled so that the outer race 13*a* surrounds the inner race 13*b* with the balls 13*c* in between, and round covers 16 are mounted on the outer and inner races 13*a* and 13*b* so as to cover them together. As a result, the blade assembly 12 that includes the blade 14 rotatable around the inner race 13*b* via the balls 13*c* and the outer race 13*a* is obtained. The covers 16, made of for example metal, cover the gaps on both sides of the outer and inner races 13*a* and 13*b*. Thus, the blade 14 has no play in either axial or radial direction on the bearing part 13.

Figure 3:
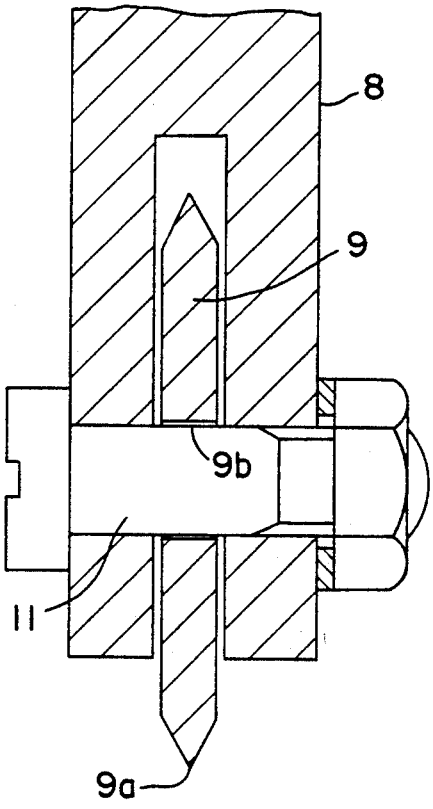
FIG. 3 PRIOR ART
FIG. 3 is a cross section of a conventional rotary blade.

The rotary blade assembly 12 of the present invention thus obtained is used in a tile cutter in place of the conventional disk-shape rotary blade 9 shown in FIG. 3.

In use, an attachment shaft 17 is inserted into the central hole of the inner race 13*b* of the bearing part 13 and then attached to the base part 8 of the operating lever 7. When the attachment shaft 17 is fastened to the base part 8 of the operating lever 7, the blade assembly 12 and therefore the blade 14 is mounted so that the blade assembly 12 does not move axially nor radially on the attachment shaft 17, thus being held in a fixed position but rotatable.

As seen from the above, the blade assembly of the present invention that includes a rotary blade has the following advantages:

(1) The cut made in the tile surface is narrow and deep, because the rotary blade has no play when the blade is pressed against the tile surface and rolled. Accordingly, the tile is accurately cut regardless of the type, thickness, material, etc.

(2) There is little rotational frictional resistance when the rotary blade is pressed against the tile surface and rolled on the tile surface, because the rotary blade rotates about the attachment shaft via the bearing part. Accordingly, smooth rotation and movement are secured. Thus, the tile is cut accurately in a simple manner regardless of the skill or degree of training of the worker. Thus, the working efficiency can be improved.

(3) There is no wear due to friction between the bearing part and the attachment shaft, because the inner race of the bearing part is fixed in place so that it does not move on the attachment shaft, but the outer race with the blade thereon can still rotate smoothly. Accordingly, the rotary blade has a long useful life and is superior in terms of maintenance characteristics.

I claim:

1. A rotary blade assembly for use in a tile cutter which includes an operating lever that moves while being guided by guide rails installed above a base and a blade installed at a lower end of a base part of the operating lever so as to make a cut in a tile surface before a tile is split by pressing, said blade assembly comprising a bearing part and an annular cutting blade part wherein a circular groove is formed in a center of an outside surface of an outer race of the bearing part, and the cutting blade part is provided in the circular groove of the outer race and comprises a cutting blade which has a V-shaped cross section formed on a rim of the cutting blade part.

2. A rotary blade assembly for a tile cutter comprising:

a cylindrical inner race;

a cylindrical outer race provided so as to surround said inner race with circular spaces in between said inner race and said outer race, said outer race having an external circular groove at a middle portion thereof;

a plurality of metal balls rotatably installed in said circular spaces;

a ring-shaped blade securely fixed in said circular groove; and a pair of covers covering said inner and outer races so as to form said inner and outer races into a single unit.

* * * * *